US006143693A

United States Patent [19]

Irving et al.

[11] Patent Number: 6,143,693

[45] Date of Patent: Nov. 7, 2000

[54] IMAGING MEMBER WITH CATALYTIC CENTERS

[75] Inventors: Lyn M. Irving; Richard P. Szajewski, both of Rochester, N.Y.

[73] Assignee: Eastman Kodak Company, Rochester, N.Y.

[21] Appl. No.: 09/161,883

[22] Filed: Sep. 28, 1998

[51] Int. Cl.[7] ..... B41M 5/00

[52] U.S. Cl. ..... 503/201; 347/105; 428/195; 428/211; 428/323; 428/341; 428/411.1; 503/216

[58] Field of Search ..... 347/105; 428/195, 428/211, 323, 341, 411.1; 503/201, 216

[56] References Cited

PUBLICATIONS

The American College Encyclopedic Dictionary, 1959, p. 692.

*Primary Examiner*—Bruce Hess
*Attorney, Agent, or Firm*—Paul A. Leipold

[57] ABSTRACT

The invention relates to an imaging member comprising at least one layer comprising catalytic centers and an aqueous permeable matrix wherein said imaging member is substantially free of photosensitive silver halide. It further relates to a method of imaging comprising supplying an oxidant and imagewise applying at least one soluble dye forming coupler in developer solution to such an imaging member.

40 Claims, No Drawings

IMAGING MEMBER WITH CATALYTIC CENTERS

FIELD OF THE INVENTION

This invention relates to an imaging member comprising at least one light insensitive layer comprising a catalytic center. It further relates to a method of imaging comprising imagewise applying to such a member distinct developer solutions that will react at said catalytic center to produce dyes of different colors.

BACKGROUND OF THE INVENTION

It has become quite popular to form images on plain or treated papers by the imagewise deposition of inks. This deposition can take place by means of contact or impact printing, as in a printing press or typewriter like arrangement or by a variety of more modern non-impact printing systems. One of these non-impact printing systems is known as ink jet printing.

In ink jet printing, tiny droplets of ink are projected directly onto a receptor surface for printing without physical contact between the printing device and the receptor. The placement of each drop on the printing substrate is controlled electronically. Printing is accomplished by moving the printhead across the paper, or by moving the paper across the printhead.

Different types of ink jet printing are known. Two major forms of ink jet printing are "drop-on-demand" printing and "continuous jet" printing. Continuous jet printing is characterized by pressure-projecting inks through a nozzle to generate drops of ink directed in a continuous stream towards the ink receiving element, while passing through an imagewise modulated ink deflection system, thereby allowing ink droplets of the stream to deposit imagewise on the recording element. Drop-on-demand or impulse ink jet differs from continuous ink jet in that the ink supply is maintained at or near atmospheric pressure. An ink drop is ejected from a nozzle only on demand when controlled excitation coming from pressure generated by a piezoelectric element or from pressure generated by local electrothermal evaporation of liquid (thermal bubble jet) is applied to an ink filled channel ending in a nozzle. Acoustic, microfluidic, and electrostatic driven drop-on-demand techniques are also known. These technologies are described in detail by J. L. Johnson, *Principles of Non-Impact Printing,* Palatino Press, Irvine, Calif. (1986), and in *Neblette's Imaging Processes and Materials,* Eight Edition, J. Sturges Ed. Van Nostrand, New York, (1989).

When several ink streams are independently employed to imagewise deliver colored inks to a surface, color images can be obtained The inks employed for this purpose typically fall into one of two categories, pigmented inks and soluble inks. The pigmented inks have the advantage of providing stable color images but are lacking in that the pigment particles rest at the surface of the receiving element and are especially prone to mechanically induced smear and rub-off. Additionally, heads delivering the pigmented inks are prone to clogging. The soluble inks solve the rub-off and clogging problems but suffer in that they are prone to both thermal and light fading and to image smearing in humid environs or when the receiving element is hand handled or otherwise wetted.

In related art, Oelbrandt et al in U.S. Pat. No. 5,621,448 describes the imagewise application of a reducing agent solution to a receiving element having a reducible silver salt to imagewise form a metallic silver image. The possibility of intensifying this black image by the presence of color coupler dyes is mentioned. Sambucetti and Seitz, in IBM Technical Disclosure Bulletin vol. 20, pages 5423–4 (1978), describe the formation of images by imagewise applying a jet or mist of a reactive species to a paper impregnated with a reactant to again form metallic images. Leenders et al in U.S. Pat. No. 5,621,449 describes imagewise applying a reducing agent to a receiver element comprising a reducible silver salt to form a metallic silver image. The possibility of intensifying this black image by the presence of color coupler dyes is mentioned. The methods described by these workers are directed at providing black images which, in some cases, may be intensified by the presence of color couplers. These methods all suffer in that the receiving element or the imagewise mist must contain between them sufficient developing agent and metal salts to form a dense image, thus requiring that large quantities of solution be employed to deliver the components. The element dries slowly and forms only a black-and-white image at best. Pimbley, in IBM Technical Disclosure Bulletin vol. 23, pages 1387 (1980), discloses that leuco dyes or vat dyes can be applied to a paper coated or impregnated with an oxidizing agent. This method suffers in that the leuco or vat dyes are unstable and, thus, leads to a material having poor shelf life. Sufficient details to practice this disclosure are not revealed.

PROBLEM TO BE SOLVED BY THE INVENTION

There is a need for permanent high quality color images that may be formed using digital addressable solution printers.

SUMMARY OF THE INVENTION

It is an object of this invention to provide an imaging member that has excellent raw stock and storage stability.

It is a further object of this invention to provide an imaging member that enables the production of viewable images having excellent color saturation and color gamut.

It is another object of the invention to provide an imaging member that enables the production of viewable color images having excellent resistance to dark and light fade, as well as resistance to image smear and rub-off.

It is yet another object of this invention to provide an imaging member that enables the production of viewable color images with good resistance to moisture and humidity.

It is yet a further object to provide a method of image formation which results in colorful and stable images that are resistant to dark and light fade, not susceptible to image smear and rub-off and stable to moisture and humidity.

It is also an object of this invention to provide a method of image formation that alleviates the problem of head clogging.

These and other objects of the invention are accomplished by providing an imaging member comprising at least one layer comprising catalytic centers and an aqueous permeable matrix wherein said imaging member is substantially free of photosensitive silver halide.

The objects of the invention are further accomplished by providing a method of imaging comprising providing an imaging member comprising at least one layer comprising catalytic centers and an aqueous permeable matrix wherein said imaging member is substantially free of photosensitive silver halide, and imagewise applying a soluble dye forming coupler and a developing solution to said imaging member.

The objects of the invention are additionally accomplished by providing a method of imaging comprising providing an imaging member comprising at least one layer comprising an aqueous permeable matrix wherein said imaging member is substantially free of photosensitive silver halide, supplying the imaging member with an oxidant and catalytic centers and imagewise applying a soluble dye forming coupler and a developing solution to said imaging member.

ADVANTAGEOUS EFFECT OF THE INVENTION

The invention provides a new technology for forming images that produces waterproof permanent images using digital printers.

DETAILED DESCRIPTION OF THE INVENTION

The invention has numerous advantages. The imaging member of the invention shows excellent raw stock stability and images formed using the member show excellent resistance to dark and light fade, are insensitive to moisture, temperature and humidity, and show excellent resistance to image smear and rub-off. Further, the color images show high saturation and excellent color gamut. The method of providing images is simple, fast, and easy to operate. Additionally, both the material and the method are compatible with a variety of solution application apparatus, thus making the material and method of great value to those already owning digitally addressable solution application printers. By applying a soluble yet stable photographic coupler, an oxidant and a soluble yet stable photographic coupling developers to a member having appropriate catalytic centers, dyes of exceptional stability and colorfulness can be formed in an imagewise manner. Since the dyes are formed in a protected environment, the problems of image smear and rub-off are alleviated. The photographic dyes formed are especially stable against dark, light, and humidity induced fade. Since the dyes are ballasted, they are also resistant to moisture and humidity induced image smear. By providing the dye forming agents in soluble form, the problems associated with head clogging encountered with particulate dyes and pigmented inks are avoided. These and other advantages will be apparent from the detailed description below.

The imaging member of the invention comprises at least one light insensitive layer comprising a catalytic center. This light insensitive layer is the locus of image formation and is also referred to as an imaging layer. In one embodiment, the light insensitive layer comprises a homogeneous admixture of catalytic center in a water permeable vehicle. In another embodiment, the light insensitive layer is itself formed from two or more homogeneous sub layers which differ in composition. In this latter case, one sub layer can be rich in catalytic center relative to another. When sub layers are employed they can be adjacent or separated by interlayers. Distinct sub layers can alternatively comprise differing concentrations of catalytic center so as to enable overall concentration gradients in the component. Different sub layers can contain a common species of catalytic center. Alternatively, distinct catalytic centers employing distinct catalysts can be employed in one light insensitive layer or in more than one layer or sub layer. In another embodiment, the imaging layer is supplied substantially free of catalytic centers and these are applied as part of the imaging process. The imaging member is preferably light insensitive.

The imaging member can additionally comprise a support which can be a reflective support or a transparent support. When reflective, the support is generally white. When transparent, the support is generally clear, although it can be tinted. Details of support construction are well known in the paper and photographic arts. Particular photographic supports especially useful in this invention, including subbing layers to enhance adhesion, are disclosed in *Research Disclosure,* published by Kenneth Mason Publications, Ltd., Dudley house, 12 North Street, Emsworth, Hampshire PO10 7DQ, England. Vol. 389, September 1996, Item 38957, XV. Supports. In another embodiment, the member can comprise a peelable support and an adhesion layer enabling a formed image to be applied to an object as, for example, to form a customized decorative item. The support can be supplied in roll or sheet form. Alternatively, the support can be a rigid member. In one embodiment, an imaging layer can be located on only one side of the support. In another embodiment, imaging layers can be located on both sides of the support to provide for double sided images, ease of use, and anticurl properties. In yet another embodiment, the imaging layer and the support can form an integral unit. In this embodiment, the support itself can function as a vehicle for the multifunctional dye forming coupler and the catalytic enter. The imaging layer can be of any suitable thickness. When the imaging layer differs in composition from the support, it will generally be between 1 and 50 $\mu$m in thickness. Preferably, it will be between 2 and 40 $\mu$m in thickness. More preferably, it will be between 3 and 30 $\mu$m in thickness.

TABLE 1

| Imaging Member |
|---|
| Support |

Table 1 shows, in schematic form, an embodiment of an imaging member of the invention. This embodiment comprises an imaging layer coated on a support. The imaging layer comprises the catalytic centers in an aqueous permeable matrix. In the pictured embodiment, the developers or developer precursors and the soluble dye forming couplers are applied imagewise to the imaging layer along with an oxidant. The oxidant reacts with the imagewise applied developers or developer precursors at the catalytic centers to form the oxidized form of the developers or developer precursors. The oxidized form of the developer or developer precursor, in turn, reacts with the applied soluble coupler to form dye deposits in an imagewise fashion relative to the position at which the developer or developer precursor and the coupler were initially applied. In this way a viewable image is formed. The process is repeated with several combinations of coupler, developer, and oxidant to provide a full color image.

By way of illustration, a transparent support is coated with a hardened gelatin layer comprising particles of iron oxide along with a protective hydrophilic colloidal overcoat layer. A solution of coupler C-1 and 4-(N-ethyl-N-2-hydroxyethyl)-2-methylphenylenediamine along with a solution of hydrogen peroxide is applied in an imagewise fashion, and an imagewise cyan dye deposit is formed. A solution of coupler C-11 and 4-(N-ethyl-N-2-methanesulfonylaminoethyl)-2-methylphenylenediamine, along with a solution of hydrogen peroxide, is applied in an imagewise fashion, and an imagewise magenta dye deposit is formed. A solution of coupler C-22 and N,N-diethyl-p-phenylenediamine along with a solution of hydrogen peroxide is applied in an imagewise fashion, and an imagewise yellow dye deposit is formed, thus, together forming a full color image which can be directly viewed, projected, or backlighted.

By way of further illustration of a distinct embodiment, a paper is impregnated with copper sulfate. A solution coupler C-6, a solution of 4-N,N-diethyl-2-methanesulfonylaminoethylphenylenediamine, and a solution of sodium persulfate is applied in an imagewise fashion, and an imagewise cyan dye deposit is formed. A solution of C-17, a solution of 4-amino-2,6-dichlorophenol, and a solution of sodium persulfate is applied in an imagewise fashion, and an imagewise magenta dye deposit is formed. A solution of C-23, a solution of 2-hyrazinobenzothiazole, and a solution of sodium persulfate is applied in an imagewise fashion, and an imagewise yellow dye deposit is formed, thus together forming a full color image suitable for direct viewing.

In illustration of yet another embodiment, both sides of a reflective support are coated with a subbing layer, then coated with hydrophilic colloidal layer, followed by a protective overcoat layer having a UV absorber. A solution of coupler C-5 and manganese chloride, a solution of 4-(N-ethyl-N-2-methanesulfonylaminoethyl)-2-methylphenylenediamine, and a solution of hydrogen peroxide is applied in an imagewise fashion, and a cyan dye deposit is formed. A solution of coupler C-19 and manganese chloride, a solution of 4-N,N-diethyl-2-methanesulfonylaminoethylphenylenediamine, and a solution of hydrogen peroxide is applied in an imagewise fashion, and an imagewise magenta dye deposit is formed. A solution of coupler C-25 and manganese chloride, a solution of 4-N,N-diethyl-2-methylphenylenediamine, and a solution of hydrogen peroxide is applied in an imagewise fashion, and an imagewise yellow dye deposit is formed. In this way a full color image is formed. The same solutions are then applied in a different imagewise fashion to the opposite side of the member, and a second image is formed. In this way, a two-sided viewable color image is formed.

The imaging member can additionally comprise an overcoat layer that provides for the physical protection of the light insensitive layer before, during, or after image formation. An overcoat layer provides a convenient location for incorporation of addenda that are most effective at or near the surface of the member. The overcoat can be divided into a surface layer and one or more interlayer, the interlayer functioning as a spacer layer between addenda in the surface layer and the imaging layer. In a common variant form, addenda are distributed between the surface layer, any interlayer, and the imaging layer with the positioning of the addenda dictated by compatibility of the addenda with the intended function of each layer. These addenda are typically agents which aid in the manufacture and preparation of the imaging member, and in the stability of the imaging member before, during, and after image formation. Typical addenda include but are not limited to coating aids, plasticizers, lubricants, antistats, anti-matting agents, stabilizers, gloss promoting agents, and ultraviolet light absorbers all as known in the photographic and papermaking arts. Wicking layers which serve to segregate moisture can further be employed. These layer structures and addenda are well known in the art and are disclosed, inter alia at *Research Disclosure,* Item 38957, and at *Research Disclosure,* Item 37038 (1995), Section VI, Polymeric Addenda, Section VII, Structure of Stabilizers, Section X, UV Stabilizers, and Section XI, Surfactants, the disclosures of which are incorporated by reference.

The light insensitive layer will generally comprise a vehicle chosen to allow admission of color developer in an imagewise manner. When the color developer is supplied in an aqueous state, the vehicle will be adequately water permeable so as to accept the color developer solution. Any vehicle known in the art which has the requisite properties can be employed for this purpose. Most generally, this will be a hydrophilic colloidal material. In one embodiment the hydrophilic colloidal material can be gelatin or a modified gelatin, such as acetylated gelatin, phthalated gelatin, or oxidized gelatin. Alternatively, the hydrophilic colloidal material can be another water soluble polymer or copolymer including, but not limited to poly(vinyl alcohol), partially hydrolyzed poly(vinylacetate/vinylalcohol), hydroxy cellulose, poly(acrylic acid), poly(1-vinylpyrrolidinone), poly(sodium styrene sulfonate), poly(2-acrylamido-2-methane sulfonic acid), and polyacrylamide. Copolymers of these polymers with hydrophobic monomers can also be employed. These hydrophilic colloidal materials can be employed alone or in admixture with other hydrophilic colloidal materials. When the member comprises sub layers, overcoats or such, the vehicle employed in each of these various layers can be the same or can differ so as to provide improved properties. The vehicle can be cross-linked or hardened, all as disclosed in *Research Disclosure,* Item 38957, already cited. Alternatively, non-aqueous color developer solutions and hydrophobic vehicles permeable to these solutions can be employed and are specifically contemplated. The vehicle can be colorless or tinted. When the vehicle is colorless, this means that the optical density of the vehicle in the visible region, i.e., between 400 and 700 nm, is up to 0.2, is preferable up to 0.1, and more preferable up to 0.05.

The catalytic center comprises a metal or metal salt. Any metal or metal salt known in the art which enables the oxidation of the reduced form of a color coupling color developer or its precursor by an oxidant can be employed for this purpose. Examples of such metals and metal salts include those chosen from the Group VIIIA and Group IB metals and their salts. Specific examples include the metallic deposits of and salts of iron, cobalt, nickel, rhodium, iridium, silver, gold, platinum, palladium, ruthenium, osmium, and copper. In one preferred embodiment, the metal is Carey Lea silver. The catalytic center will generally be of a size and optical density so as not to interfere with viewing of images borne by the imaging member. The catalytic center can be atomic, molecular, or particulate in nature. When the catalytic center is particulate, it typically has a particle size of up to 5 $\mu$m, and preferably has a particle size of up to 1 $\mu$m, and more preferably has a particle size of up to 0.1 $\mu$m. Specific catalytic center materials are preferably selected from the group consisting of deposits of silver, gold, copper, and iron in metallic or salt form. The catalytic center can be incorporated in the imaging member in any manner known in the art. When the catalytic center is a soluble species, it can be incorporated by solution in the member at manufacture. When the catalytic center is particulate, it can typically be incorporated as such in the member at manufacture. Alternatively, the catalytic center can be applied to a member prior to, during, or immediately after the application of the developer solution, thereby forming the inventive member in situ. The metal or metal salt forming the catalytic center can be employed in any useful quantity. It is preferred that the catalytic center be applied to the member at between about 0.01 and 50 mg/m$^2$. It is more preferred that the catalytic center be applied to the member at between about 0.1 and 10 mg/m$^2$.

The molar ratio of the catalytic center to the applied couplers is typically less than about 1:10, preferably less than about 1:50, more preferably less than about 1:100, and most preferably less than about 1:1000. Minimal amounts of catalytic center are preferably employed so as to both minimize the effect of these centers on the visual characteristics of the imaging member and to promote the stability of the member both before and after image formation. In one embodiment, the member is provided free of an effective quantity of catalytic center, and one or more form of catalyst is applied to the member as part of the imaging process The dye forming coupler can be any known coupler that possesses the requisite property of being sufficient soluble to be delivered as a solution and of forming color dyes with the oxidized forms of color developers. Most generally, such a coupler will have the following structure I:

(I)

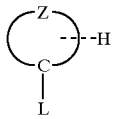

wherein:

C is a carbon atom at which coupling occurs;

L represents a hydrogen atom or a leaving group covalently bound to C and which is displaced on coupling;

H is an acidic hydrogen atom serving to direct coupling to C and which is covalently bound to C directly or by conjugation; and Z represents the remainder of the atoms of the coupler, in cyclic or acyclic form, which together provide sufficient electron withdrawal to render H acidic and together provide sufficient ballast function to render the dye formed from the coupler immobile, subject to the proviso that L and Z together are sufficiently hydrophilic to render the coupler soluble in solution. When L is H, then the dye-forming coupler is a 4-equivalent dye-forming coupler. When L is a leaving group which is displaced on coupling, then the dye-forming coupler is a 2-equivalent dye-forming coupler.

Typically, a coupler can be rendered sufficiently hydrophilic by limiting the extent of hydrocarbon ballasting, as know in the art. Additionally, the coupler can have one or more solubilizing substituents. Moieties such as hydroxy, alkoxy, carboxy, sulfoxy, phosphoroxy, boroxy, amino, ureido, and their salts are particularly contemplated in this regard. The degree of water solubilization of a compound can be quantified as its octanol/water partition coefficient as taught by Leo et al, *Journal of Medicinal Chemistry,* 18, No. 9, pages 865–868 (1975). The more negative the partition coefficient, the higher the water solubility of a compound. The couplers useful in the practice of this invention will typically exhibit, in their ionized form if such exists, an octanol/water partition coefficient, log P, more negative than, i.e., less than, 1. Preferably the log P value will be less than 0, more preferably less than −1, and most preferably less than −2.

The coupler I can be monomeric or polymeric in nature. Further, it can be substituted with one or more of a linear or branched carbonaceous group which can be cyclic or acyclic, a heterocyclic group, an aromatic carbonaceous group, an arylalkyl group, a halogen atom, a cyano group, a nitro group, a ureido group, an ether group, an ester group, an amine group, an amide group, a thioether group, a thioester group, a sulfonyl group, or a sulfamyl group.

Couplers useful in the practice of this invention are described in *Research Disclosure,* Item 38957, Section X. Dye Image Formers and Modifiers, in *Research Disclosure,* Item 37038 (1995), in Katz and Fogel, *Photographic Analysis,* Morgan & Morgan, Hastings-on-Hudson, New York, 1971 in the Appendix, in Lau et al, U.S. Pat. No. 5,670,302, and in European Patent Application EP 0 762 201 A1, the disclosures of which are all incorporated by reference. The couplers most useful in the practice of this invention are those employed in the Kodak Kodachrome™ Process.

Specific preferred couplers include, but are not limited to, the following couplers:

C-1

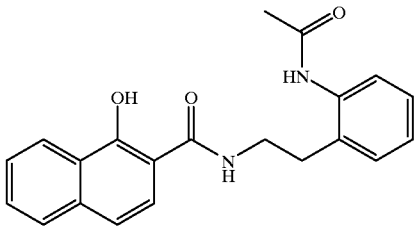

C-2

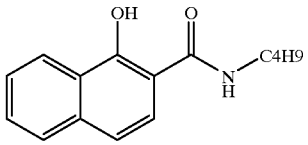

C-3

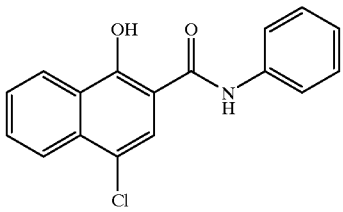

C-4

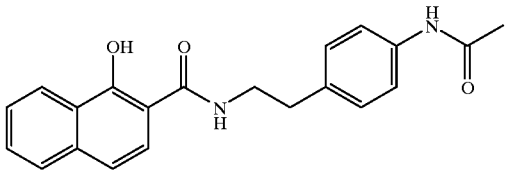

C-5

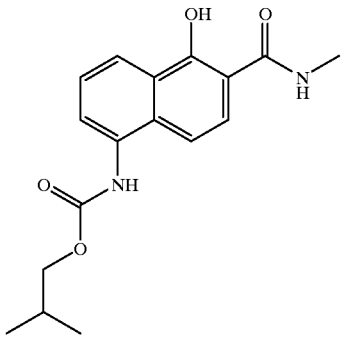

-continued
C-6
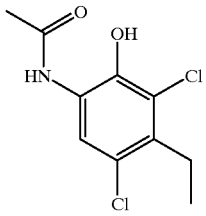
C-7
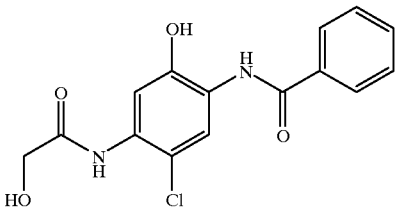
C-8
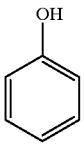
C-9
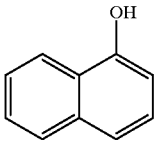
C-10
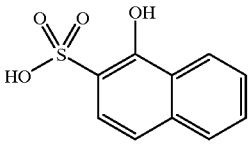
C-11
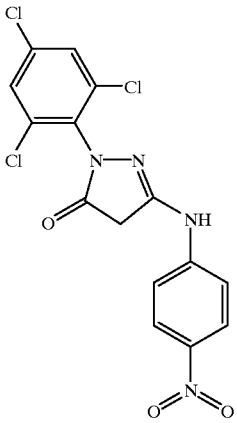
-continued
C-12
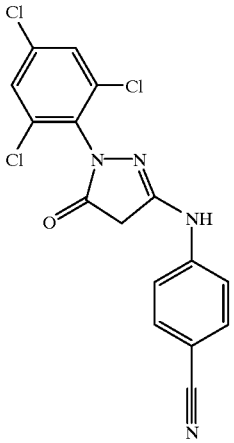
C-13
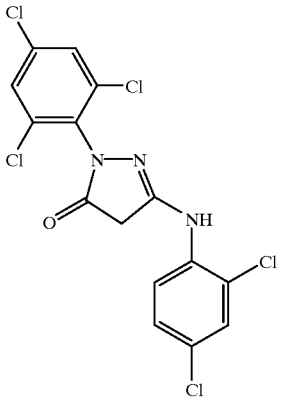
C-14
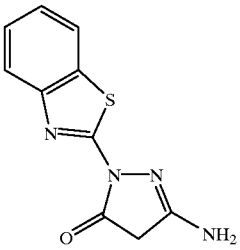
C-15
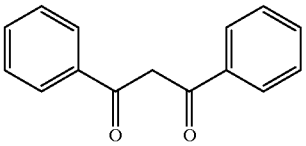
C-16
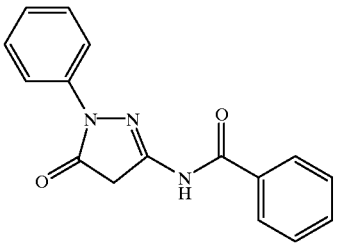

-continued

C-17

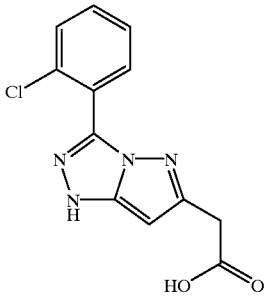

C-18

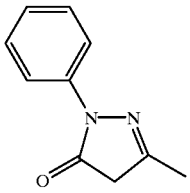

C-19

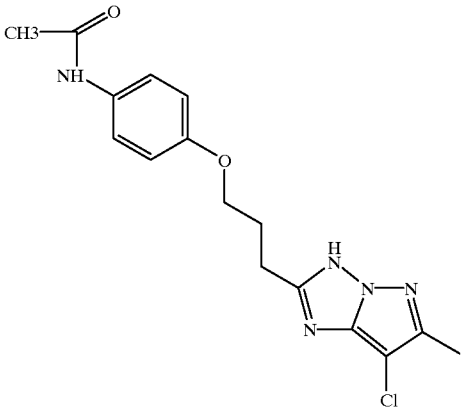

C-20

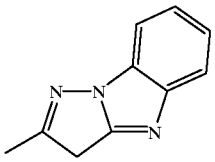

C-21

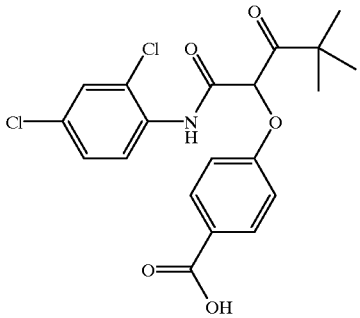

-continued

C-22

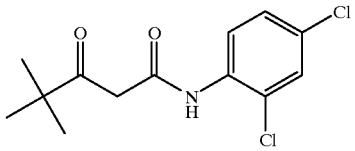

C-23

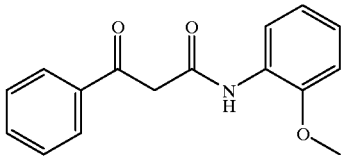

C-24

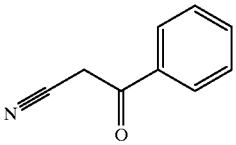

C-25

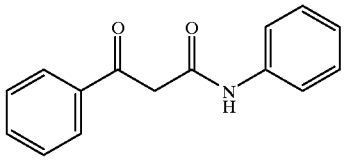

C-26

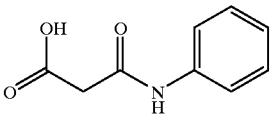

C-27

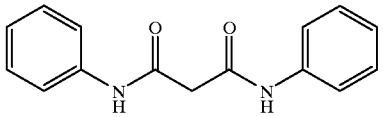

C-28

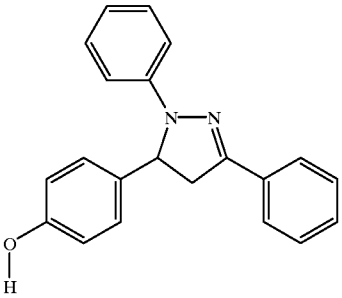

Mixtures of couplers can be employed in the practice of this invention. The couplers or coupler precursors are generally applied in an imagewise fashion to the member from a coupler solution. While the coupler solution can be aqueous or non-aqueous, an aqueous solution is generally preferred. When the coupler solution is an aqueous solution, it can contain pH adjusting agents and coupler or coupler precursor stabilizers. The pH of the solution can be adjusted for optimum cross-oxidation as known in the art, or it can be adjusted for optimum storage stability. In the latter case, the pH of the member can be adjusted separately. The pH adjustment can employ a buffer consisting of an organic or inorganic acid or base and/or a salt thereof. Useful examples include phosphoric acid and salts of phosphates, sulfuric acid and salts of sulfate, citric acid and salts of citrate, boric acid and salts of borate or metaborate, acetic acid and salts of acetate, carbonate salts, amines and amine salts, urea derivatives and their salts and ammonium hydroxide or mixtures thereof. Coupler stabilizers can be present in the coupler solution, as known in the art. Additionally, the coupler can be supplied in a blocked form which unblocks and releases the coupler before or during a coupling reaction. When the coupler is supplied in its blocked form, that form can be any blocked form known in the art that unblocks under the conditions encountered in practicing the invention. In addition to the blocking groups already described, couplers that are deactivated as sulfate, hydrochloride, sulfite, and p-tolunenesulfonate salts, or are deactivated as metal complexes, all as known in the art, are specifically contemplated. The concentration of the coupler or coupler precursor in the coupler solution will be that needed to enable adequate density formation to be attained on applying the developer solution to the member. Preferably, the coupler or coupler precursor will be present in the coupler solution at a concentration between about 0.5 and 100 g/L. It is more preferred that the coupler or coupler precursor will be present in the coupler solution at a concentration between about 1 and 50 g/L.

The imaging member can further comprise an incorporated solvent. In this embodiment, any of the high boiling organic solvents known in the photographic arts as "coupler solvents" can be employed. In this situation, the solvent acts as a manufacturing aid. Alternatively, the solvent can be incorporated separately. In both situations, the solvent can further function as a hue shifter, a coupler stabilizer, a dye stabilizer, a reactivity enhancer or moderator, or as a hue shifting agent, all as known in the photographic arts. Additionally, auxiliary solvents can be employed to aid dissolution of the multifunctional dye forming coupler in the coupler solvent. Particulars of coupler solvents and their use are described in the aforesaid mentioned references and at *Research Disclosure,* Item 37038 (1995), Section IX, Solvents, and Section XI, Surfactants, incorporated herein by reference. Specifically useful coupler solvents include, but are not limited to, tritoluyl phosphate, dibutyl phthalate, N,N-diethyldodecanamide, N,N-dibutyldodecanamide, tris (2-ethylhexyl)phosphate, acetyl tributyl citrate, 2,4-di-tert-pentylphenol, 2-(2-butoxyethoxy)ethyl acetate, and 1,4-cyclohexyldimethylene bis(2-ethylhexanoate). The choice of coupler solvent and vehicle can influence the hue of dyes formed as disclosed by Merkel et al in U.S. Pat. Nos. 4,808,502 and 4,973,535. Most generally it is found that materials with a hydrogen bond donating ability can shift dyes bathochromically, while materials with a hydrogen bond accepting ability can shift dyes hypsochromically. Additionally, use of materials with low polarizability can of itself promote hypsochromic dye hue shifts, as well as promote dye aggregation. It is recognized that coupler ballasts often enable dyes and dye-coupler mixtures to function as self-solvents with a concomitant shift in hue. The polarizability and the hydrogen bond donating and accepting ability of various materials are described by Kamlet et al in *J. Org. Chem,* 48, 2877–87 (1983), the disclosures of which are incorporated by reference. In another embodiment, the application of developer, coupler, and oxidant in non-aqueous fashion to a member comprising a hydrophobic vehicle is contemplated.

The developers useful in the practice of the invention will generally be of structure II:

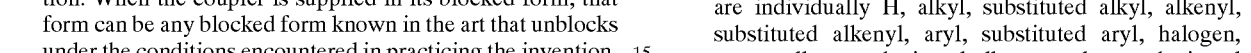

$$A—(CR1{=}CR2)_n—NHY \quad (II)$$

wherein:

n is 0, 1 or 2;

A is OH, or NR3R4;

Y is H, or a group that reacts before or during a coupling reaction to form H; and R1, R2, R3, and R4, which can be the same or different are individually H, alkyl, substituted alkyl, alkenyl, substituted alkenyl, aryl, substituted aryl, halogen, cyano, alkoxy, substituted alkoxy, aryloxy, substituted aryloxy, amino, substituted amino, alkylcarbonamido, substituted alkylcarbonamido, arylcarbonamido, substituted arylcarbonamido, alkylsulfonamido, arylsulfonamido, substituted alkylsulfonamido, substituted arylsulfonamido, or sulfamyl or wherein at least two of R1, R2, R3, and R4 together further form a substituted or unsubstituted carbocyclic or heterocyclic ring structure.

When Y is a group that reacts before or during a coupling reaction to form H, then Y is preferably the moiety Q—R6 wherein:

R6 is H, alkyl, substituted alkyl, alkenyl, substituted alkenyl, alkynyl, substituted alkynyl, aryl, substituted aryl, heterocyclic or substituted heterocyclic; and Q is $—SO_2—$, —SO—, $—SO_3—$, —CO—, —COCO—, —CO—O—, —CO(NR7)—, —COCO—O, —COCO—N(R7)—, or $—SO_2—N(R7)—$, where R7 is H or the groups described in R6.

In one preferred embodiment, the partial structure $—(CR1{=}CR2)_n—$ represents a substituted or unsubstituted phenyl moiety. When $(CR1{=}CR2)_n$ represents an aromatic moiety, the moieties A— and —NHY are preferably in a para relationship, one to another.

In another preferred embodiment, the developer can be of structure III:

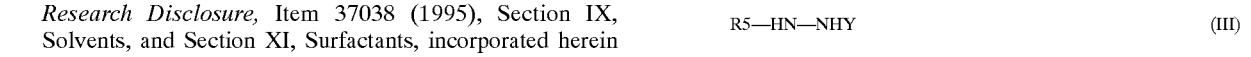

$$R5—HN—NHY \quad (III)$$

wherein R5 is alkyl, substituted alkyl, alkenyl, substituted alkenyl, aryl, substituted aryl, substituted carbonyl, substituted carbamyl, substituted sulfonyl, substituted sulfamyl, heterocyclic or substituted heterocyclic; and Y is as defined above.

In structures II, and III, the word "substituted" at each occurrence represents any group other than H needed to satisfy the required valence which does not adversely affect the required properties. The word "substituted" preferably represents one or more of a linear or branched carbonaceous group which can be cyclic or acyclic, a heterocyclic group, an aromatic carbonaceous group, an arylalkyl group, a halogen atom, a cyano group, a nitro group, a ureido group, an ether group, an ester group, an amine group, an amide group, a thioether group, a thioester group, a sulfonyl group, or a sulfamyl group.

The developer structures described above are generally 2-electron equivalent developers.

Specific examples of developers include, but are not limited to, color developer chosen from the group consisting of N,N-diethyl-p-phenylenediamine, 4-N,N-diethyl-2-methylphenylenediamine, 4-(N-ethyl-N-2-methanesulfonylaminoethyl)-2-methylphenylenediamine, 4-(N-ethyl-N-2-hydroxyethyl)-2-methylphenylenediamine, 4-N,N-diethyl-2-methanesulfonylaminoethylphenylenediamine, 4-(N-ethyl-N-2-methoxyethyl)-2-methylphenylenediamine, 4,5-dicyano-2-isopropylsulfonylhydrazinobenzene, 4-amino-2,6-dichlorophenol, 4-N,N-diethyl-2-methyl-6-methoxyphenylenediamine, 4-N,N-diethyl-2,6-dimethylphenylenediamine, 4-(N-ethyl-N-2-methanesulfonylaminoethyl)-2,6-dimethylphenylenediamine, 4-(N-ethyl-N-2-hydroxyethyl)-2,6-dimethylphenylenediamine, 4-N,N-diethyl-2-methanesulfonylaminoethyl-6-methylphenylenediamine, 4-(N-ethyl-N-2-hydroxyethyl)-2-ethoxyphenylenediamine, 4-amino-4,5-dihydro-5-oxo-1-phenyl-1H-pyrazole-3-carboxamide, 4-(N-ethyl-N-2-methoxyethyl)-2,6-dimethylphenylenediamine. 2-hydrazino-2-imidazoline, 4-hydrazinobenzoic acid, 2-hydrazinobenzoic acid, 4-hydrazinobenzenesulfonic acid, 9-hydrazinoacridine, 2-hyrazinobenzothiazole, 1-hydrazinophthalazine, 2-hydrazinopyridine, 3-(hydrazinosulfonyl)benzoic acid, 3-hydrazinoquinoline, 1,3-diethyl-2-hydrazinobenzimidazole, 4-(N-ethyl, N-carbonamidomethyl)-phenylenediamine, and 4-morpholinophenylenediamine.

Other useful developers and developer precursors are disclosed in *The Theory of the Photographic Process,* 4th ed., T. H. James, ed., Macmillan, New York 1977 at pages 291–403, by Hunig et al, *Angew. Chem.,* 70, page 215-ff (1958), by Schmidt et al U.S. Pat. No. 2,424,256; Pelz et al U.S. Pat. No. 2,895,825; Wahl et al U.S. Pat. No. 2,892,714; Clarke et al U.S. Pat. Nos. 5,284,739 and 5,415,981; Takeuchi et al U.S. Pat. No. 5,667,945; and Nabeta U.S. Pat. No. 5,723,277, the disclosures of which are incorporated by reference.

The individual developers or developer precursors are generally applied in an imagewise fashion to the member from a developer solution. The developer solution can be aqueous or non-aqueous. When the developer solution is an aqueous solution, it can contain pH adjusting agents and developer or developer precursor stabilizers. The pH of the solution can be adjusted for optimum cross-oxidation as known in the art, or it can be adjusted for optimum storage stability. In the latter case, the pH of the member can be adjusted separately. The pH adjustment can employ a buffer consisting of an organic or inorganic acid or base and/or a salt thereof. Useful examples include phosphoric acid and salts of phosphates, sulfuric acid and salts of sulfate, citric acid and salts of citrate, boric acid and salts of borate or metaborate, acetic acid and salts of acetate, carbonate salts, amines and amine salts, urea derivatives and their salts and ammonium hydroxide or mixtures thereof. Developer stabilizers can be present in the developer solution, as known in the art. Additionally, the developer can be supplied in a blocked form which unblocks and releases the developer before or during its oxidation or a coupling reaction. When the developer is supplied in its blocked form, that form can be any blocked form known in the art that unblocks under the conditions encountered in practicing the invention. In addition to the blocking groups already described, developers that are deactivated as sulfate, hydrochloride, sulfite and p-tolunenesulfonate salts, or are deactivated as metal complexes, all as known in the art, are specifically contemplated The concentration of the developer or developer precursor in the developer solution will be that needed to enable adequate density formation to be attained on applying the developer solution to the member. Preferably, the developer or developer precursor will be present in the developer solution at a concentration between about 1 and 100 g/L. It is more preferred that the developer or developer precursor will be present in the developer solution at a concentration between about 3 and 50 g/L.

An oxidant must be supplied to the member for image formation to occur. The oxidant can be incorporated in the member, it can be incorporated in the imagewise applied developer solutions, it can separately applied, or reliance can be placed on adventitious oxygen. Better stability is generally maintained by applying the oxidant as a separate solution.

Any oxidant known in the art which enables the oxidation of the reduced form of a color coupling color developer or its precursor to its oxidized form can be employed in the practice of this invention. The quantity of oxidant which may be most effectively employed is dictated by the stoichiometry of the coupling reaction, that is, by the stoichiometry of the reaction between the dye forming coupler and oxidized developer. Typically two electron-mole equivalents of oxidant are required to oxidize one mole of a two electron mole equivalent developer, that is, a 2-equivalent developer to its oxidized form. When one mole of a 2-equivalent dye forming coupler is employed, these two-electron mole equivalents of oxidant, embedded in the oxidized developer, enable the formation of one mole of dye by a coupling reaction. Alternatively, when one mole of a 4-equivalent dye forming coupler is employed with a 2-equivalent developer, then four electron-mole equivalents of oxidant and two moles of developer are required for the formation of one mole of dye. In this later situation, the reaction of one mole of a 4-equivalent dye-forming coupler with two moles of oxidized developer results in the formation of one mole of dye, along with the regeneration of one mole of 2-equivalent developer. Although the regenerated developer can be reemployed in a cyclic fashion, thus minimizing the quantity of excess developer present after all of the oxidant has been expended, this later situation is less preferred since any excess developer can eventually lead to the production of unwanted image dye. Preferably, the electron equivalency of the developer and the electron equivalency of the dye-forming coupler are equal. While any useful molar ratio of dye-forming coupler, developer, and oxidant may be employed, preferably about two electron-mole equivalents of oxidant are employed in combination with about one mole of a 2-equivalent developer and about one mole of 2-equivalent dye forming coupler to form maximum density in the practice of this invention. In another embodiment, about four electron-mole equivalents of oxidant are employed in combination with about two moles of a 2-equivalent developer and about one mole of 4-equivalent dye forming coupler to form maximum density in the practice of this invention. These optimal ratios can be adjusted to compensate for any inefficacy in the underlying reactions. Practically, the molar ratio of oxidant, counted as electrons, to 2-equivalent dye-forming coupler is about 2:1. Preferably the molar ratio of oxidant, counted as electrons, to 2-equivalent dye-forming coupler is between about 1.8:1 and 3:1. Likewise, the molar ratio of oxidant, counted as electrons, to 4-equivalent dye-forming coupler is about 4:1. Preferably the molar ratio of oxidant, counted as electrons, to 4-equivalent dye-forming coupler is between about 3.6:1 and 6:1.

The imaging member itself can be provided substantially free of incorporated oxidant to promote the stability of the member before image formation. By substantially free of incorporated oxidant is meant that the molar ratio of any incorporated oxidant to the multifunctional dye-forming coupler is less than about 1:10, preferably less than about 1:50, more preferably less than about 1:100, even more preferably less than about 1:1,000; and most preferably less than about 1:10,000.

In one embodiment, the oxidant employed is a metal salt which forms metallic deposits on its reduction. Examples of such metal salts include the salts of vanadium, chromium, manganese, iron, cobalt, nickel, copper, niobium, molybdenum, ruthenium, rhodium, palladium, silver, cadmium, tantalum, tungsten, rhenium, osmium, iridium, platinum, and gold. In a preferred embodiment, the metal salt can be chosen from the reducible silver fatty acid salts, the reducible salts of silver alkylacetylide, the reducible salts of silver arylacetylide, the reducible salts of silver alkylamines, the reducible salts of silver arylamines, the reducible salts of heterocyclic silver mercaptides, and the reducible salts of heterocyclic silver thiones. In a particularly preferred embodiment, the metal salt is silver behenate, silver benzotriazole, silver acetylide, or silver 5-amino-2-benzylthiotriazole.

In another embodiment, the oxidant employed is a metal salt which can oxidize the applied developers without itself being fully reduced to a metallic form. This embodiment is advantageous since it leads to an imaging member which forms images lacking in an overall tint caused by reduced metal deposits. Metal salts of metals chosen from Group VA, Group VIA, Group VIIA, Group VIIIA, and Group IB of the periodic table of the elements can be employed in this regard. Examples of such metal salts include, but are not limited to, the higher oxidation state complexes of vanadium, chromium, manganese, iron, cobalt, nickel, copper, niobium, molybdenum, ruthenium, rhodium, palladium, silver, cadmium, tantalum, tungsten, rhenium, osmium, iridium, platinum, and gold.

When a metal salt is employed, the metal salt will generally be of a size and optical density so as not to interfere with viewing of images borne by the imaging member. The metal salt can be atomic, molecular, or particulate in nature. When the metal salt is particulate, it typically has a particle size of up 30 $\mu$m, preferably of up 10 $\mu$m, and more preferably of up 3 $\mu$m. The particles can generally have a size of at least 0.1 $\mu$m and preferably of at least 0.5 $\mu$m. The metal salt can be incorporated in the imaging member in any manner known in the art. When the metal salt is a soluble species, it can be incorporated by solution in the member at manufacture. When the metal salt is particulate, it will typically be incorporated as such in the member at manufacture. Alternatively, the metal salt can be applied to a member prior to, during, or immediately after the application of the developer solution, thereby forming the inventive member in situ. The metal salt can be employed in any useful quantity. It is preferred that the metal salt be applied to the member at between about 0.2 and 3 g/m$^2$. It is more preferred that the metal salt be applied to the member at between about 0.5 and 2.5 g/m$^2$. The minimum quantity of metal salt required is dictated by the efficiency of dye formation and by the extinction coefficient of the formed dyes. When the reducible metal salt forms metallic particle on reduction, the quantity of metal salt employed should be held as close as possible to this minimum quantity so as to avoid the formation of excess density from metallic particles which can be formed in the imaging member.

In a preferred embodiment, the reducible metal salt chosen is one which can be air oxidized from its reduced form to a more highly oxidized form which is colorless in this more oxidized form. In yet another preferred embodiment, the reducible metal salt chosen is one which is colorless in its reduced form. Such metal salts are well known in the art. These metal salts are especially useful in this invention since highly colored images of improved gamut and hue can be formed in this way.

In another embodiment, a non-metallic oxidant can be employed. The non-metallic oxidant can be incorporated in the member, it can be incorporated in the imagewise applied developer solutions, it can separately applied, or reliance can be placed on adventitious oxygen. Better stability can be attained by applying the oxidant as a separate solution. Any oxidant useful for cross-oxidizing the developers or developer precursors can be employed. Preferably, the oxidant is a peracid oxidant or its salt. Typical peracid oxidants useful in the practice of this invention include the hydrogen, alkali, and alkali earth salts of persulfate, peroxide, perborate, and percarbonate, oxygen, and the related perhalogen oxidants such as hydrogen, alkali, and alkali earth salts of chlorate, bromate, iodate, perchlorate, perbromate and metaperiodate. Hydrogen peroxide solution is the preferred oxidant. When applied in a less than fully imagewise fashion, the oxidant can serve the dual function of not only oxidizing the imagewise applied developer or developer precursor, but also acting to whiten the member in areas lacking developer or developer precursor, thus providing for improved gamut and brighter colors.

When the oxidant is applied in a solution, the pH of the solution can be pre-adjusted for optimum cross-oxidation as known in the art, or it can be pre-adjusted for optimum storage stability, with final pH adjustment supplied by the developer solution. The pH adjustment can employ a buffer consisting of an organic or inorganic acid or base and/or a salt thereof. Useful examples include phosphoric acid and salts of phosphates, citric acid and salts of citrate, boric acid and salts of borate or metaborate, acetic acid and salts of acetate, amines and amine salts, urea derivatives and their salts and ammonium hydroxide. Oxidant stabilizers can be present in an oxidant solution as known in the art. Additionally, the oxidant can be supplied in a blocked form which unblocks and releases the oxidant. When the oxidant is supplied from an oxidant solution, the oxidant will preferably be present in the oxidant solution at a concentration between about 1 and 100 g/L. It is more preferred that the oxidant will be present in the oxidant solution at a concentration between about 2 and 50 g/L.

An auxiliary developer or electron transfer agent as known in the art can additionally be present in the member during image formation to aid the catalytic center in its interaction with the developer and the oxidant. The auxiliary developer or electron transfer agent can be incorporated in the member at manufacture, or it can be added to the member before or during image formation. Additionally, oxidized developer scavengers and competing developers can be added to the member before, during, or after image formation to aid in the stability, color reproduction, and colorfulness of the member and the produced images. These and other useful agents are described, inter alia, at *Research Disclosure,* Item 37038 (1995), Section III, and at *Research Disclosure,* Item 38957 (1996), Section XIX.

Generally distinct developers or developer precursors and distinct soluble couplers are employed in the practice of this invention. These developers can be any developers known in the art that are coupling developers. It is preferred that the developers and couplers chosen form distinctly colored dye deposits. By distinctly colored is meant that the dyes formed differ in the wavelength of maximum adsorption by at least 50 nm. It is preferred that these dyes differ in the maximum adsorption wavelength by at least 65 nm, and more preferred that they differ in the maximum adsorption wavelength by at least 75 nm. It is further preferred that at least a cyan and a magenta, or a cyan and a yellow, or a magenta and a yellow dye are formed. Preferably, a cyan dye-forming developer and coupler, a magenta dye-forming developer and coupler, and a yellow dye-forming developer and coupler are employed to form respectively cyan, magenta, and yellow dyes. In another embodiment a black dye forming developer and coupler pair are additionally employed. In yet another embodiment multiple cyan dye forming, magenta dye forming, and yellow dye forming combinations can be employed to form a greater gamut of colors or to form colors at greater bit depth.

A cyan dye is a dye having a maximum absorption at between 580 and 700 nm, with preferably a maximum absorption between 590 and 680 nm, more preferably a peak absorption between 600 and 670 nm, and most preferably a peak absorption between 605 and 655 nm. A magenta dye is a dye having a maximum absorption at between 500 and 580 nm, with preferably a maximum absorption between 515 and 565 nm, more preferably a peak absorption between 520 and 560 nm, and most preferably a peak absorption between 525 and 555 nm. A yellow dye is a dye having a maximum absorption at between 400 and 500 nm, with preferably a maximum absorption between 410 and 480 nm, more preferably a peak absorption between 435 and 465 nm, and most preferably a peak absorption between 445 and 455 nm. A black has nearly equal absorption across the optical region, i.e., from 400 to 700 nm. The concentrations and amounts of the distinct developers and distinct couplers will typically be chosen so as to enable the formation of dyes having a density at maximum absorption of at least 0.7, preferably a density of at least 1.0, more preferably a density of at least 1.3, and most preferably a density of at least 1.6. Further, the dyes will typically have a half height band width (HHBW) of between 70 and 170 nm in the region between 400 and 700 nm. Preferably, the HHBW will be less than 150 nm, more preferably less than 130 nm, and most preferably less than 115 nm. Additional details of preferred dye hues are described by McInerney et al in U.S. Pat. Nos. 5,679,139; 5,679,140; 5,679,141; and 5,679,142, the disclosures of which are incorporated by reference.

The coupler solution and the developer solution can be imagewise applied to the imaging member in any manner known in the art. In one embodiment, the coupler and developer can be thermally ablated in an imagewise manner from a donor sheet to the imaging member. In a preferred embodiment, the coupler is carried in a coupler solution and developer is carried in a developer solution, and both solutions are imagewise applied to the imaging member. These solutions can be the same or different. A preferred method of imagewise application of solutions is by the technique colloquially known as "ink jet". In ink jet application, tiny droplets of solution are projected directly onto the imaging member without physical contact between the projecting device and the imaging member. The placement of each drop on the imaging member is controlled electronically. The projecting device is called a printhead. Imaging is accomplished by moving the printhead across the imaging member, or by moving the imaging member across the printhead. One or more printheads, each driving one of more projected streams is known in the art are specifically contemplated for use in the invention.

Different types of ink jet projection are known. Two major forms of ink jet projection are "drop-on-demand" projection and "continuous jet" projection. Continuous jet projection is characterized by pressure-projecting developer solution through a nozzle to generate drops of developer solution directed in a continuous stream towards the imaging member while passing through an imagewise modulated solution deflection system, thereby allowing developer solution droplets of the stream to deposit imagewise on the imaging member. Drop-on-demand or impulse ink jet differs from continuous ink jet in that the developer solution supply is maintained at or near atmospheric pressure. A drop is ejected from a nozzle only on demand when controlled excitation coming from pressure generated by a piezoelectric element or from pressure generated by local electrothermal evaporation of liquid (thermal bubble jet) is applied to a developer filled channel ending in a nozzle. Acoustic, microfluidic, and electrostatic driven drop-on-demand techniques are also known. These technologies, as they apply to the application of inks, are described in detail by J. L. Johnson, *Principles of Non-Impact Printing,* Palatino Press, Irvine, Calif. (1986), and in *Neblette's Imaging Processes and Materials,* Eight Edition, J. Sturges Ed. Van Nostrand, New York, (1989). Both drop-on-demand and continuous developer solution applications are particularly contemplated as imagewise solution application techniques to be employed in the practice of this invention.

In employing ink jet application of developer solution, any size and any number of drops can be applied to a specific area of the imaging member to best form the desired image. The size and the number of drops of solution are controlled by the specific design of the printhead and by the electronic driver of the printhead. The electronic driver of the printhead, in turn, is controlled by the digital characteristics of the digitized image being printed. The individual drops will typically be between 1 and 50 picoliters in volume. The individual drops will preferably be less that 30 picoliters and more preferable less than 10 picoliters in volume. The use of smaller drops is preferred since the imaging member is less wetted and since this better allows the application of multiple drops to a particular area of the imaging member. Any individual area of the imaging member can receive between 1 and 50 drops. In a preferred embodiment, any individual area of the imaging member will receive at least 3 drops, one from each of three printheads delivering distinct developer solutions which enable the formation of cyan, magenta, and yellow dyes. It is more preferred to employ four printheads to deliver distinct developer solutions, thereby enabling the formation of cyan, magenta, yellow, and black dyes. In another embodiment, an imaging apparatus can be configured to employ distinct printheads to deliver developer solutions according to this invention and to also deliver soluble inks or particulate inks as known in the art. This latter mode is particularly preferred when a black image deposit is desired. In yet another embodiment, six solution delivery systems, each delivering a distinct developer, can be employed to independently form two cyan images differing in density or hue, two magenta images differing in density or hue, a yellow image, and a black image at the imaging member.

The imaging member can be heated during or after application of the developer. This heating has many useful functions including, but not limited to, driving the oxidation and reduction reactions to completion, driving the coupling reaction to completion, and drying the imaging member. When the imaging member is heated, it will generally be heated to a temperature of from ambient room temperature to a temperature of up to about 200° C. Temperatures between about 25° C. and about 100° C. are preferred, while temperatures between about 30° C. and about 80° C. are more preferred. Lower temperatures are generally preferred since they require less energy and promote greater image and imaging member stability. However, higher temperatures can be useful to promote speed of image formation and drying. The imaging member can be held at an elevated temperature for whatever time is required to achieve adequate density formation. Heating times of up to 120 seconds are generally adequate, while heating times of up to 60 seconds are preferred, heating times of up to 30 seconds are more preferred, and heating times of 10 seconds are most preferred. Most generally, higher temperatures enable the use of shorter heating times as is well known in the chemical arts. Any known apparatus suitable for heating can be employed for this purpose.

The following examples illustrate the practice of this invention. They are not intended to be exhaustive of all possible variations of the invention. Parts and percentages are by weight unless otherwise indicated.

EXAMPLES

The following examples illustrate the image-wise application of three separate soluble color coupling agents, color developers and an oxidant to an imaging layer containing catalytic silver centers. The appropriate selection of developing agents and multifunctional color coupler provide waterfast cyan, magenta, and yellow dyes in the imaging layer.

Example 1

Carey Lea silver was prepared in the following manner. To 290 cc of 0.65 M NaOH were dissolved 9.07 grams of dextrin at 40° C., and then 197 cc of a 0.58 M $AgNO_3$ solution were added at a rate of 130 cc/minute to precipitate silver particles with an average volume of ca. 0.002 cubic $\mu$m. An imaging layer was prepared which contained 0.24 mg/m$^2$ of Carey Lea Silver, 0.080 g/m$^2$ of hardening agent bis(vinylsulfonyl)methane, and 4.74 g/m$^2$ of gelatin. This imaging layer was coated on a reflection support.

One gram of coupler C-1 was dissolved in a mixture of 15 g of distilled water, 3.5 g of hexylene glycol, and 0.25 g of sodium hydroxide. 1.5 g of the resulting solution was added to 10 g of an aqueous solution containing 0.1 grams of 4-(N-ethyl-N-2-hydroxyethyl)-2-methylphenylenediamine. The pH of this solution was adjusted to 12. This solution was applied in an imagewise fashion to the image receiving layer using an Epson Stylus 200 ink jet printer to deliver the coupler solution. A solution containing 5% hydrogen peroxide and 5 g/l of sodium carbonate was delivered uniformly over the image receiving layer using an Epson Stylus 200 ink jet printer. Status A reflection densities are shown in Table 2 for a region of the image receiving layer where the solution of coupler C-1 was applied. The high red optical density and low green and blue densities illustrate that a cyan dye formed in the regions where the coupler solution was applied.

This procedure was repeated except the coupler solution contained coupler C-11 instead of coupler C-1. Status A reflection densities are shown in Table 2 for a region where the solution of coupler C-11 was applied. The high green optical density and low red and blue densities illustrate that a magenta dye formed in the regions where the solution of coupler C-11 was applied.

This procedure was repeated except the coupler solution contained coupler C-21. Status A reflection densities are shown in Table 2 for a region where the solution of coupler C-21 was applied. The high blue optical density and low red and green densities illustrate that a yellow dye formed in the regions where the solution of coupler C-21 was applied.

The results in Table 2 illustrate that the color images obtained have both high optical density and color gamut.

TABLE 2

| Coupler | Red Density | Green Density | Blue Density |
|---|---|---|---|
| C-1 | 1.77 | 0.29 | 0.31 |
| C-11 | 0.30 | 1.09 | 0.43 |
| C-21 | 0.09 | 0.26 | 1.12 |

To measure the waterfastness of the image dyes, the reflection density corresponding to peak absorption for the color patches was measured before and after immersing the paper in warm (40° C.) distilled water for 5 minutes and drying the coating. The waterfastness was calculated as the percentage of the initial reflection density retained after this treatment. That is, a waterfastness value of 100 indicates the reflection density did not change, and a value of 0 indicates that all of the image dye was removed from the paper during the waterfastness test. Table 3 shows that the cyan, magenta, and yellow image dyes are completely waterfast.

TABLE 3

| Region | Invention |
|---|---|
| Cyan | 99 |
| Magenta | 100 |
| Yellow | 99 |

Example 2

An imaging layer was prepared in the same way as in Example 1, except the imaging layer also contained 0.32 g/m$^2$ of 4-(N-ethyl-N-2-hydroxyethyl)-2-methylphenylenediamine. The cyan reservoir of a color ink jet printer cartridge for an HP Deskjet 600 printer was filled with a solution containing 0.5% of coupler C-1 and 0.25% of sodium persulfate. The magenta reservoir was filled with a solution containing 0.5% coupler C-11 and 0.25% of sodium persulfate. The yellow reservoir was filled with a solution containing 0.5% coupler C-21 and 0.25% of sodium persulfate. Using the ink jet printer, image patterns of the three coupler solutions were applied to the image receiving layer. Cyan dye formed in the regions where the solution of coupler C-1 was applied. Magenta dye formed in the regions where the solution of coupler C-11 was applied, and yellow dye formed in the regions where the solution of coupler C-21 was applied. A portion of the image pattern consisted of a region where only the solution of coupler C-1 was applied, a region where only the solution of coupler C-11 was applied, and a region where only the solution of coupler C-21 was applied. Status A reflection densities for these three regions are shown in Table 4. The results in Table 4 illustrate that the color images obtained have both high optical density and color gamut. The waterfastness was measured as described in Example 1 and results are shown in Table 5. The results in Table 5 demonstrate that the image dyes are completely waterfast.

TABLE 4

| Coupler | Red Density | Green Density | Blue Density |
|---|---|---|---|
| C-1 | 1.38 | 0.35 | 0.45 |
| C-11 | 0.37 | 1.47 | 0.51 |
| C-21 | 0.09 | 0.31 | 1.34 |

TABLE 5

| Region | Invention |
|---|---|
| Cyan | 100 |
| Magenta | 99 |
| Yellow | 101 |

Comparative Example 3

To further illustrate the advantage in waterfastness obtained by practicing the current invention, the cyan, magenta, and yellow inks in an HP51641A color ink jet cartridge were applied to a photo quality ink jet paper to generate cyan, magenta, and yellow color patches. The waterfastness of these image dyes was measured as described above, and results are shown in Table 6. All three HP dyes had poor waterfastness, with only 2–45% of the initial reflection density retained, depending on the image dye. It is clear by comparing the waterfastness values in Tables 3 and 5 to those in Table 6 that practice of the current invention provides an output material with excellent waterfastness.

TABLE 6

| Color patch | Comparison, HP inks |
|---|---|
| Cyan | 45 |
| Magenta | 20 |
| Yellow | 2 |

The invention has been described in detail with particular reference to certain preferred embodiments thereof, but it will be understood that variations and modifications can be effected within the spirit and scope of the invention.

What is claimed is:

1. An imaging member comprising a support, and an imaging layer, said layer further comprising catalytic centers chosen from the group consisting of metal and metal salts wherein said imaging member is substantially free of photosensitive silver halide.

2. The imaging member of claim 1 wherein said imaging layer has an optical density of up to 0.2 in the optical region.

3. The imaging member of claim 1 wherein said catalytic centers have a particle size of up to 5 $\mu$m.

4. The imaging member of claim 1 comprising said catalytic centers at between 0.01 and 50 mg/m$^2$.

5. The imaging member of claim 1 wherein said catalytic centers comprise Carey Lea silver.

6. The imaging member of claim 1 wherein said catalytic centers comprise at least one material selected from the group consisting of the metallic deposits of and salts of iron, cobalt, nickel, rhodium, iridium, silver, gold, platinum, palladium, ruthenium, osmium, and copper.

7. The imaging member of claim 1 wherein said support is a reflective support.

8. The imaging member of claim 1 wherein said support is a transparent support.

9. The imaging member of claim 1 wherein said imaging layer has a thickness of between 1 and 50 $\mu$m.

10. The imaging member of claim 1 wherein said layer comprises a colloid.

11. The imaging member of claim 1 wherein said layer comprises a paper.

12. A method of imaging comprising applying a soluble dye forming coupler in solution and a developer solution to an imaging member according to claim 1, wherein at least one of the developer and coupler is applied in an imagewise fashion.

13. The method of claim 12 wherein there is further imagewise applied a second soluble dye forming coupler in solution and a developer solution to said imaging member.

14. The method of claim 13 wherein there is further imagewise applied a third soluble dye forming coupler in solution and a developer solution to said imaging member.

15. The method of claim 14 wherein said first dye forming coupler comprises a cyan dye forming coupler, said second dye forming coupler comprises a magenta dye forming coupler, and said third dye forming coupler comprises a yellow dye forming coupler.

16. The method of claim 13 wherein said first dye forming coupler comprises a cyan dye forming coupler and said second dye forming coupler comprises a magenta dye forming coupler.

17. The method of claim 12 wherein said coupler is of structure I:

(I)

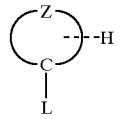

wherein:

C is a carbon atom at which coupling occurs;

L represents a hydrogen atom or a leaving group covalently bound to C and which is displaced on coupling;

H is an acidic hydrogen atom serving to direct coupling to C and which is covalently bound to C directly or by conjugation; and Z represents the remainder of the atoms of the coupler, in cyclic or acyclic form which together provide sufficient electron withdrawal to render H acidic and together provide sufficient ballast function to render the dye formed from the coupler immobile, subject to the proviso that L and Z together are sufficiently hydrophilic to render the coupler soluble in solution.

18. The method of claim 17 wherein said coupler has a solubilizing substituent chosen from the group consisting of hydroxy, alkoxy, carboxy, sulfoxy, phosphoroxy, boroxy, amino, ureido, and their salts.

19. The method of claim 12 wherein said coupler is characterized in having an octanol/water partition coefficient of less than 1.

20. The method of claim 12 wherein said coupler is chosen from the group consisting of coupler C-1 through coupler C-28.

21. The method of claim 12 wherein said developer is of structure II:

$$A—(CR1{=}CR2)_n—NHY \quad (II)$$

wherein:

n is 0, 1 or 2;

A is OH, or NR3R4;

Y is H, or a group that reacts to form H before or during a coupling reaction; and R1, R2, R3, and R4 which can be the same or different are individually H, alkyl, substituted alkyl, alkenyl, substituted alkenyl, aryl, substituted aryl, halogen, cyano, alkoxy, substituted alkoxy, aryloxy, substituted aryloxy, amino, substituted amino, alkylcarbonamido, substituted alkylcarbonamido, arylcarbonamido, substituted arylcarbonamido, alkylsulfonamido, arylsulfonamido, substituted alkylsulfonamido, substituted arylsulfonamido, or sulfamyl or wherein at least two of R1, R2, R3, and R4 together further form a substituted or unsubstituted carbocyclic or heterocyclic ring structure.

22. The method of claim 21 wherein $—(CR1{=}CR2)_n—$ represents a substituted or unsubstituted phenyl moiety.

23. The method of claim 22 wherein the moieties A— and —NHY are in a para relationship, one to another.

24. The method of claim 21 wherein Y is Q—R6, wherein: R6 is H, alkyl, substituted alkyl, alkenyl, substituted alkenyl, alkynyl, substituted alkynyl, aryl, substituted aryl, heterocyclic or substituted heterocyclic, and Q is $—SO_2—$, —SO—, $—SO_3—$, —CO—, —COCO—, —CO—O—, —CO(NR7)—, —COCO—O, —COCO—N(R7)—, or $—SO_2—N(R7)—$, where R7 is H or the groups described in R6.

25. The method of claim 12 wherein the developer is of structure III:

$$R5—HN—NHY \quad (III)$$

wherein R5 is alkyl, substituted alkyl, alkenyl, substituted alkenyl, aryl, substituted aryl, substituted carbonyl, substituted carbamyl, substituted sulfonyl, substituted sulfamyl, heterocyclic or substituted heterocyclic; Y is H, or a group that reacts before or during a coupling reaction to form H.

26. The method of claim 12 wherein said developer is chosen from the group consisting of N,N-diethyl-p-phenylenediamine, 4-N,N-diethyl-2-methylphenylyenediamine, 4-(N-ethyl-N-2-methanesulfonylaminoethyl)-2-methylphenylenediamine, 4-(N-ethyl-N-2-hydroxyethyl)-2-methylphenylenediamine, 4-N,N-diethyl-2-methanesulfonylaminoethylphenylenediamine, 4-(N-ethyl-N-2-methoxyethyl)-2-methylphenylenediamine, 4,5-dicyano-2-isopropylsulfonylhydrazinobenzene, 4-amino-2,6-dichlorophenol, 4-N,N-diethyl-2-methyl-6-methoxyphenylenediamine, 4-N,N-diethyl-2,6-dimethylphenylenediamine, 4-(N-ethyl-N-2-methanesulfonylaminoethyl)-2,6-dimethylphenylenediamine, 4-(N-ethyl-N-2-hydroxyethyl)-2,6-dimethylphenylenediamine, 4-N,N-diethyl-2-methanesulfonylaminoethyl-6-methylphenylenediamine, 4-(N-ethyl-N-2-hydroxyethyl)-2-ethoxyphenylenediamine, 4-amino-4,5-dihydro-5-oxo-1-phenyl-1H-pyrazole-3-carboxamide, 4-(N-ethyl-N-2-methoxyethyl)-2,6-dimethylphenylenediamine. 2-hydrazino-2-imidazoline, 4-hydrazinobenzoic acid, 2-hydrazinobenzoic acid, 4-hydrazinobenzenesulfonic acid, 9-hydrazinoacridine, 2-hyrazinobenzothiazole, 1-hydrazinophthalazine, 2-hydrazinopyridine, 3-(hydrazinosulfonyl)benzoic acid, 3-hydrazinoquinoline, 1,3-diethyl-2-hydrazinobenzimidazole, 4-(N-ethyl,N-carbonamidomethyl)-phenylenediamine, and 4-morpholinophenylenediamine.

27. The method of claim 12 further comprising the step of applying an oxidant to said imaging member.

28. The method of claim 27 wherein said oxidant is a peracid oxidant or its salt.

29. The method of claim 28 wherein said oxidant is chosen from the group consisting of the hydrogen, alkali and alkali earth salts of persulfate, peroxide, perborate, and percarbonate, chlorate, bromate, iodate, perchlorate, perbromate, and metaperiodate.

30. The method of claim 27 wherein said oxidant is hydrogen peroxide.

31. The method of claim 27 wherein said oxidant is a high oxidation state metal.

32. The method of claim 12 wherein said member further comprises an oxidant.

33. The method of claim 12 wherein said oxidant is supplied is said developer solution.

34. The method of claim 12 wherein said oxidant is supplied in said coupler solution.

35. The method of claim 12 wherein said coupler solution and said developer solution are the same solution.

36. The method of claim 12 wherein imagewise application of developer solutions is by ink jet.

37. A method of imaging comprising:

supplying a catalyst chosen from the group consisting of metal and metal salts to an imaging member, said member comprising a support having an imaging layer and being substantially free of photosensitive silver halide;

supplying an oxidant to said member;

applying a soluble dye forming coupler to said member; and applying a developer solution to said member;

wherein at least one of the developer and coupler is applied in an imagewise fashion.

38. An imaging article comprising a vehicle chosen from the group consisting of a paper and a colloid, said vehicle having catalytic centers chosen from the group consisting of metal and metal salts wherein said imaging article is substantially free of photosensitive silver halide.

39. A method of imaging comprising applying a soluble dye forming coupler in solution and a developer solution to an imaging article according to claim 38, wherein at least one of the developer and coupler is applied in an imagewise fashion.

40. A method of imaging comprising:

supplying a catalyst chosen from the group consisting of metal and metal salts to an imaging article, said article comprising a vehicle chosen from the group consisting of a paper and a colloid and being substantially free of photosensitive silver halide;

supplying an oxidant to said member;

applying a soluble dye forming coupler to said member; and applying a developer solution to said member;

wherein at least one of the developer and coupler is applied in an imagewise fashion.

* * * * *